United States Patent [19]

Harris, Jr. et al.

[11] 4,144,560

[45] Mar. 13, 1979

[54] ADAPTIVE CONTROL FOR SIGNAL PROCESSING

[75] Inventors: Samuel C. Harris, Jr.; Terry L. Hewitt, both of Waynesboro, Va.

[73] Assignee: General Electric Company, Waynesboro, Va.

[21] Appl. No.: 744,815

[22] Filed: Nov. 24, 1976

Related U.S. Application Data

[62] Division of Ser. No. 534,600, Dec. 20, 1974, Pat. No. 4,009,654.

[51] Int. Cl.[2] ..... B41J 5/30

[52] U.S. Cl. ..... 364/113; 364/121; 364/519; 364/900

[58] Field of Search ..... 235/151.22, 150.1; 364/113, 121, 519, 900

[56] References Cited

U.S. PATENT DOCUMENTS

| | | | |
|---|---|---|---|
| 3,408,633 | 10/1968 | Shimabukuro | 364/900 |
| 3,582,897 | 6/1971 | Marsh, Jr. | 364/900 |
| 3,697,958 | 10/1972 | Larew | 364/900 |
| 3,803,558 | 4/1974 | Jones et al. | 364/900 |

*Primary Examiner*—David H. Malzahn
*Attorney, Agent, or Firm*—Michael Masnik

[57] ABSTRACT

An arrangement for processing data by modifying selected bit portions of coded control signals for comparison with coded input signals to control printing by a printer.

4 Claims, 5 Drawing Figures

ADAPTIVE CONTROL FOR SIGNAL PROCESSING

This is a division, of application Ser. No. 534,600, filed Dec. 20, 1974 now U.S. Pat. No. 4,009,654.

BACKGROUND OF THE INVENTION

The present invention relates to electronic adaptive control circuit and more particularly to method and means for processing data by modifying selected bit portions of coded control signals for comparison with coded input signals to control printing by a printer.

There are a wide variety of printers shown in the prior art. There are slow printers such as those that print a single character at a time and high speed printers commonly referred to as line printers, as well as printers that print a partial line of characters at a time. Such printers have an ability to store in a memory the signals representing characters to be printed or recorded on a record medium. Input intelligence for each character desired to be printed is placed in storage in the memory and is used to select from a complete set of type characters for each print position the one desired to be operated for printing at that position. Reference may be made to U.S. Pat. Nos. 3,314,360 dated Apr. 18, 1967; 3,366,045 dated Jan. 30, 1968; 2,874,634 dated Feb. 24, 1959; 2,936,704 dated May 17, 1960; 3,099,206 dated July 30, 1963 and 3,803,558 dated Apr. 9, 1974 which are representative of some of the art prior to Applicants' invention.

In such prior art printers use is made of fixed sets of type characters. Thus, in a particular chain or belt printer arrangement the fixed sets of type characters would be presented to a line on a record medium for purposes of printing. In certain applications the restriction to a fixed number of characters in a set may be an undesirable constraint. For example, for a given size belt or chain it may be desirable to modify the number of sets of type characters in order to obtain certain flexibility of printer application. For example, by increasing the number of sets associated with any type carrier by reducing the number of type characters in any set, the access time to type characters or fingers is reduced and hence the printing rate can be increased. It is common to accommodate to change in the number of sets of type characters in any particular printer configuration by exchanging the logic circuit boards employed in controlling printing, for example, by replacing circuit boards. This approach is time consuming, expensive and troublesome. It would be desirable to be able to modify the printing operation of a printer automatically in response to a change in the number of sets of type characters presented for printing. This would enable the exchange of type carriers, such as belts, chains, drums, etc., without the necessity of changing or adjusting the print control logic circuits.

Accordingly, one object of the invention is to provide an improved apparatus for modifying selected bit portions of coded control signals for comparison with coded input signals to implement an adaptive control function.

Another object of this invention is to provide an automatic method and apparatus for controlling printing operation in response to changes in the number of type characters employed in a set for printing.

Another object of this invention is to provide an improved method and apparatus for conveniently changing the printing speed of an electronic printer by an exchange of type carriers.

Another object of this invention is to provide an improved method and apparatus for detecting a change in the number of type characters associated with a set of such characters employed in a printing operation.

Another object of this invention is to provide an an improved method and apparatus for detecting a change in the number of type characters in the sets employed in a printing operation and for modifying the printing process to accommodate such change.

Another object of this invention is to provide an improved recording method and arrangement.

In accordance with one embodiment of the invention a printing arrangement is provided for printing character signals available from a source in character serial form comprising means for producing a respective column signal for each input character signal to indicate the column in which such character signal is to be printed. Type finger or type character signals are provided, indicative of the passage of each of a plurality of type fingers arranged in a plurality of identical sets of type fingers on a common carrier through the various column positions as the type fingers are moved in succession through the various column positions along a line of print. Means are provided for algebraically combining the column signals with the finger signals to provide sum signals. In order to accommodate automatically to a change in the number of type fingers included in the sets or fonts carried by the carrier, means are provided to sense type finger passage to identify the number of type fingers carried per set by the carrier. Finally, means are provided for modifying the sum signals in response to the identified number of type fingers per set such that when the modified sum signals are compared with the character signals to produce control signals for controlling the printing, the proper type characters corresponding to the input character signals are operated at the appropriate column positions to effect printing.

BRIEF DESCRIPTION OF THE DRAWINGS

The features of the present invention believed to be novel are set forth with particularity in the appended claims. The function itself, however, both as to organization and the method of operation, together with further objects and advantages thereof may best be understood by reference to the following description taken in conjunction with the accompanying drawings, in which:

DESCRIPTION OF TYPICAL EMBODIMENTS

Before entering into a description of the present invention, it may be useful to set forth certain general concepts applicable to printers and particularly line printers which Applicants have selected as the environment in which to describe the present invention. It is obvious that the invention would be applicable in other types of printers such as character at a time or partial line printers. In a line printer, print control has two modes which exist in an alternating source. These comprise a data load mode for loading data into memory followed by a print mode which processes data in memory, erasing stored character data as the corresponding characters are printed. When all character data is printed, the load mode returns for another data transfer cycle. In one particular embodiment, the load mode data is presented in bit parallel, character serial form and it is strobed by a data strobe pulse and stored in a set of registers. The system clock synchronizes the data strobe and the data is transferred to the print memory, such as a register. Characters are transferred through the register at a very high rate as comparing to the printing rate. In one embodiment involving a printing rate of 120 lines per minute, data is entered into the register at a 60,000 chracter per second rate. This limit is determined by the synchronizing capability of the clock system employed. When the desired number of characters have been transferred to print memory, a transfer pulse is developed and printing begins. Characters will be printed along the line in the order in which they were received. When all characters have been printed an empty memory is detected and when a print complete signal is received, control is returned to the load mode.

Figure 1:
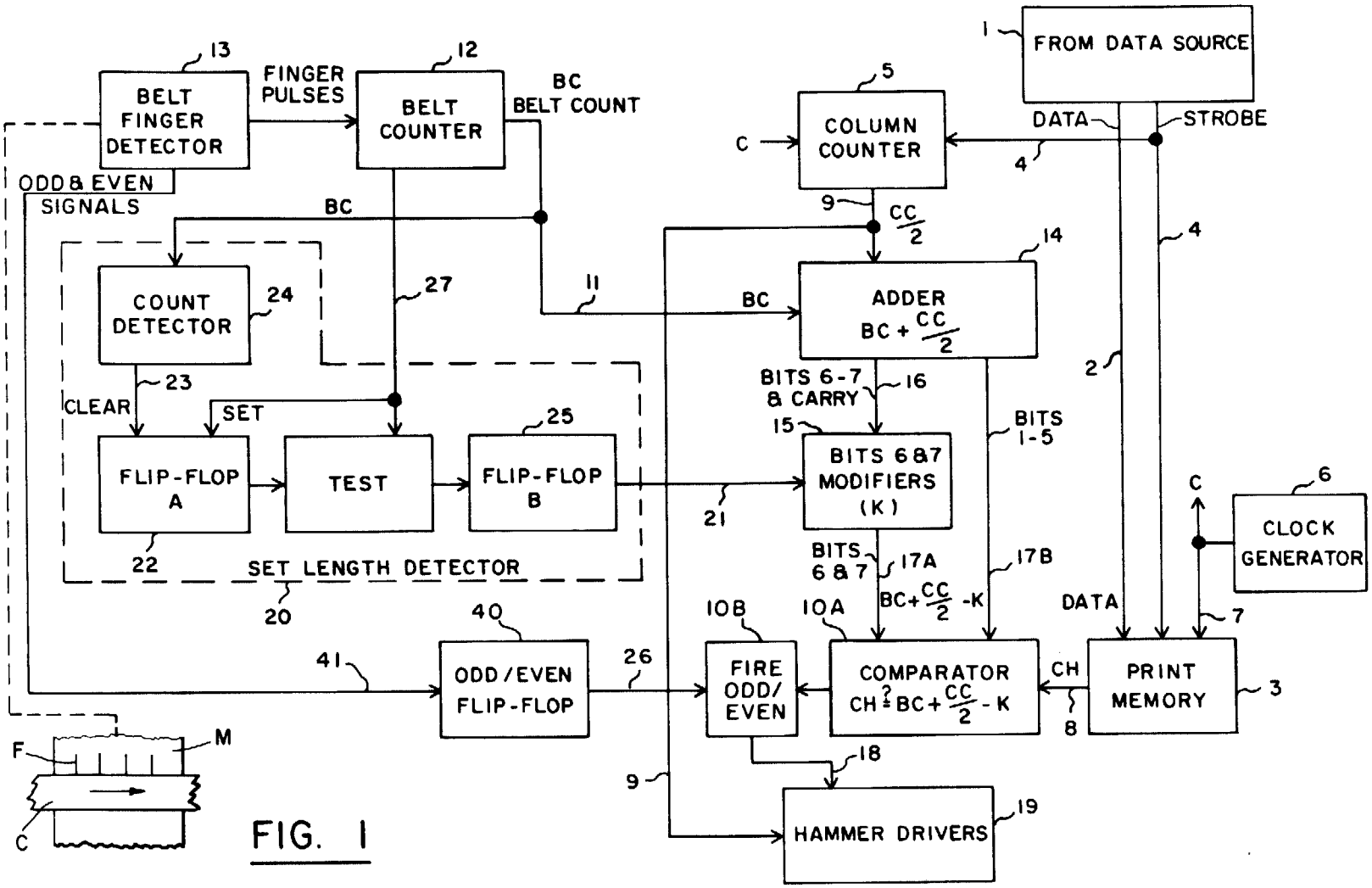
FIG. 1 shows in block diagram form certain general considerations involved in a line printer employing a belt of type fingers wherein the invention would be applicable.

Referring to FIG. 1 there is shown as generalized block diagram of one embodiment of the invention as applied to a line printer. In such a printer the input data characters received from a source 1 are applied over path 2 and stored in a print memory 3 which may be a shift register or other such storage device. Generally this involves storing a line of input data or characters at a time. The data received from the source is stored in memory in the sequence in which it is to printed along a line on a record medium such as by impact printing through an inked ribbon onto paper. The printing mechanism itself generally involves providing relative movement between printing or type characters and the record medium. This may involve type characters or fingers carried by a drum or disk, belt, etc. For purposes of this description, it shall be assumed that the printing is accomplished by flexible fingers carried by an endless belt wherein the printing type is located at one extremity of the finger. As the belt with fingers moves across a line on a record medium, hammers located along the line of printing are energized to selectively strike and drive the type bearing fingers to impact the paper through an inked ribbon. For further details of this type belt arrangement reference can be made to U.S. Pat. No. 3,803,358 issued to Clifford M. Jones and Earle B. McDowell on Apr. 9, 1974 and assigned to a common assignee. In order to accomplish printing of type characters at the desired column locations where a moving belt of type is involved, certain data needs to be processed. In the particular embodiment selected for explaining the invention, this involves comparing the input data or characters stored in memory, the column at which the characters are to be printed and the instantaneous location of the moving belt and type fingers.

In FIG. 1 a comparator 10 responds to input data characters available over lead 8 from a memory source 3 and the column information on lead 9 associated with each input data character available on 8 as well as the column location of the individual type fingers on the rotating belt available on lead 11. In the particular embodiment mentioned in the aforesaid patent the comparator performs the comparison $CH \stackrel{?}{=} BC + CC/2 - K$ where BC is the number representing or associated with the instantaneous location of a particular type finger, CH is a number representing the input data character being considered and CC is the number representing the column location at which such input data character is to be printed and where K is an integral multiple of the number of type fingers in a set and wherein the multiple is a function of the comparison formula as will be described shortly. The term CC/2 arises from the fact that in the particular embodiment to be described, type fingers have twice the spacing of the columns for physical reasons. The comparison is satisfied when a logic signal is produced indicating that the type finger at the given column location along a line on the record medium corresponds to the input data character desired to be printed at that location. For each alignment of type characters with columns along a line on the record medium the comparator performs the aforesaid comparison for all of the input data characters stored in memory and produces an equal comparison signal on lead 18 for each character in memory for which a corresponding printing character is located at the column location where such data character is to be printed. For purposes of discussion the equal compare signals available on 18 occur serially in the order in which the comparisons are carried out by comparator 10. The equal compare signals available on lead 18 are applied to the hammer drive circuit 19. Hammer drive circuit 19 comprises well known circuits which respond to equal compare signals to gate a drive signal to the hammer associated with the column selection signal available on lead 9 from source 5. The hammer drive circuit thus drives selected printing characters carried by the belt into the record medium at an appropriate time. In one particular embodiment described in greater detail in the aforementioned U.S. Pat. No. 3,099,206, as the columns are successively scanned, each equal compare signal developed at that time preconditions a respective hammer located at the corresponding column position. At the end of the compare cycle a drive signal causes only all of those hammers preconditioned to be operated to simultaneously print characters at the selected column locations. The equal comparison signal is employed to erase from storage the signal representing the character printed in order to enable subsequent characters representing signals to be stored for processing. Thus far we have provided a brief description of an existing line printer arrangement to which the invention may be applied.

Referring to FIG. 1 the data available from source 1 is applied to the circulating shift memory or signal storage register 3. The source may comprise a computer, a telephone line or any other source of digital data. Generally speaking the printers operate in a particular code format. A popular code is the ASCII code which is a multi-level code wherein a character consists of several bits and a strobe pulse. The data is applied in bit parallel, character serial form over lead 2 to the memory 3. In this arrangement it is conventional for the data source 1 to provide a strobe signal on lead 4. Clock pulses C available on line 6 are applied to memory 3. The strobe signal available on 4 applied to memory 3 shifts the memory register during data loading and applied to column counter 5 increments the column counter 5 by one for each character. After a line of data from source 1 has been entered into memory 3 under control of the strobe signal on 4, the recirculation of this data in the memory is under the control of clock signal available from a clock 6 on line 7. As the data circulates in memory during the printing sequence to be described, and following the load sequence just explained, column counter 5 under control of clock signals C provides column information for the particular data character appearing at the memory output line 8. Whatever data character appears on lead 8, its column location is defined by a signal available on lead 9 at the output of column counter 5.

For purposes of describing the comparator 10, use will be made of the symbols CH, BC, CC and K which have previously been identified. The source of BC signals in one particular embodiment was a belt counter 12 which counts pulses from a photoelectric finger detector 13 which detects the passage of individual type or print character fingers past a photoelectric cell detector. The output of detector 13 representing the passage of all individual fingers past a reference point located with respect to the moving belt when applied to belt counter 12 results in an up count. The up count on lead 11 identifies the particular alignment of the type fingers carried by the belt. The BC and CC signals available on leads 11 and 9 are applied to adder 14 where they are combined before application on lead 16 as a sum signal to the comparator 10 via bit modifier 15 and directly over leads 17 to be described shortly. Comparator 10 also receives the input data character signal available on lead 8. Comparator 10 operates to process the applied signals in accordance with the algorithm $CH \stackrel{?}{=} BC + CC/2 - K$ as previously mentioned. The processed output from 10A applied to fire circuit 10B is distributed over odd or even channels of lead 18 under control of the flip-flop 40. Flip-flop 40 controlled by the odd and even signals received over lead 41 from detector 13 identifies whether the odd or even hammers are to be operated. Whenever an equal comparison result obtains, an equal comparison signal appears on lead 18. This equal comparison signal is applied to the hammer drive circuit 19. The hammer drive circuit 19 responds to the equal comparison signal available on lead 18 and the column count signal available on lead 9 from counter 5. For each column count signal the hammer located at that particular column position is preconditioned to operate in response to drive signals available from a source not shown, if there also appears an equal compare signal at the lead 19. Thus during one alignment of the printing character one or more of the hammers are preconditioned during the compare cycle for firing during the drive cycle. During the drive cycle all of the hammers that were preconditioned are operated to cause simultaneous printing of the type characters located at the column locations associated with the characters to be printed. In one embodiment a finger pulse signal is generated for each printing character passing a finger detector. There is associated with each successive finger signal, a drive period, a commutation period and a compare period. The drive period represents the period when the preconditioned hammers are energized to simultaneously print the appropriate characters during a particular column alignment of printing fingers. The commutate period is the time between finger pulses when the hammer circuits are restored to their rest condition. The compare period is the time when the type finger or character, data and column information are processed to generate equal compare signals to be used to control printing. Anything that is printed by the hammer drive circuit 19 during the cycle is erased from memory 3 in any well known manner, not shown. When all characters in memory have been erased, the memory empty condition is sensed in any well known manner, not shown, to turn on the data source 1 and cause the next line of data characters to be introduced into memory under the control of the associated strobe signals. The data source 1 had previously been turned off in response to a signal such as for example the column counter 5 outut indicating that the memory has been filled. In a particular embodiment, the memory was designed to hold 132 columns of characters.

Thus far we have described a printing process in which each character (ASCII encoded) is placed in a storage register with a column counter incremented by clock C such that the character code remains in synchronism with the number of the column in which the character is to be printed. Following completion of the data load cycle the printing operation commences. Printing of a character requires that the type belt finger for the given character is in position over the corresponding column at the time the print hammer for that column is driven. Therefore the belt position, or belt count, is also required in order to enable a hammer fire. This information is obtained by taking the odd and even belt finger signals from the belt finger detector and counting the number of fingers which have passed a reference point. These belt signals also cause the belt counter to be initialized at the beginning of each character set. Reference is made above to odd and even belt finger signals in a printer embodiment which distinguishes between odd and even comparisons where printing takes place alternately at even and odd column locations. Reference may be made to U.S. Pat. No. 3,803,558 for the details of such an arrangement.

The character code, the column count and the belt count then become the inputs to the hammer fire comparator circuit. The hammer fire algorithm for a belt employing two sets of characters, each of 96 character length for printing in a machine of 132 columns is:

$$CH = \frac{CC}{2} + BC \qquad 32 \leq \left(\frac{CC}{2} + BC\right) \leq 127$$

$$CH = \frac{CC}{2} + BC - 96 \qquad \left(\frac{CC}{2} + BC\right) > 127$$

where :

CH = decimal number equivalent of each ASCII printable character

CC = column count = number of the column in which the given character is to be printed BC = belt count = 32 plus the number of belt fingers which have passed the reference points This algorithm is different for a belt employing three sets of 64 characters each since it must reflect a reduction in the number of characters per font as well as the condition that during each font passage there are periods where parts of all three fonts will be in position over the 132 column line. The hammer fire algorithm of th 3-set belt then becomes:

$$CH = \frac{CC}{2} + BC \qquad 32 \leq \left(\frac{CC}{2} + BC\right) \leq 95$$

-continued $$CH = \frac{CC}{2} + BC - 64 \qquad 96 \leq \left(\frac{CC}{2} + BC\right) \leq 159$$

$$CH = \frac{CC}{2} + BC - 128 \qquad \left(\frac{CC}{2} + BC\right) \leq 160$$

Referring to FIG. 1, the first step in the algorithm implementation is the addition BC + CC/2 in adder 14. The CC/2 indicates that spacing of type fingers on the belt is twice the column spacing of the machine. This was done to accommodate finger and hammer physical requirements in one embodiment. Following the addition, the sum is used to determine the modifier constant, K, in accordance with the algorithm. For example: if CC/2 + BC = 135, then K = 96 for a 2-set belt and K = 64 for a 3-set belt. The original sum is then modified in 15 by substracting the correct constant, K, in order to obtain the fingal sum CC/2 + BC − K. Note that the sum CC/2 + BC − K is modified in such a way that the final sum is maintained within the range of the character code number (32-127 for a 2-set belt and 32-95 for a 3-set belt).

The output from the set length detector 20 on lead 21 is used to select the appropriate final sum. The detector is implemented by first setting flip-flop 22 at the beginning of each set via the reset signal on 27, from the counter 12. Flip-flop 22 is then cleared when the belt count detector 24 reaches a count which is greater than the maximum count reached for 3-set belt (96) but less than the maximum count reached for a 2-set belt (127). In one embodiment, 100 is used as the value of the test count. Therefore, for a 2-set belt, flip-flop 22 will be cleared each time the belt count reaches 100 and this will cause flip-flop 25 to remain cleared, thus maintaining the output on lead 21 at logic level zero which is that state for indicating a 2-set belt. However, for a 3-set belt, the belt count will never reach the count of 100 and therefore flip-flop 22 remains set and flip-flop 25 is then set and maintained in the set condition so that the output on lead 21 goes to a logic 1 which is the state for indicating a 3-set belt.

The final sum, BC + CC/2 − K is then compared with the character code, CH in 10, to determine whether the algorithm is satisfied and a hammer should be fired. If the algorithm is satisfied, the particular hammer to be fired is determined by decoding the column counter output and by using the odd/even belt finger signals on lead 26 to determine whether the odd columns or the even columns are to be fired (since there is only one belt finger for every two columns).

The following is an explanation of the block 15 labelled "BITS 6 & 7 MODIFIERS (K)". This block concerns the modifications required to maintain the sum CC/2 + BC within the proper ranges as shown in the hammer fire algorithm equations.

Figure 2:
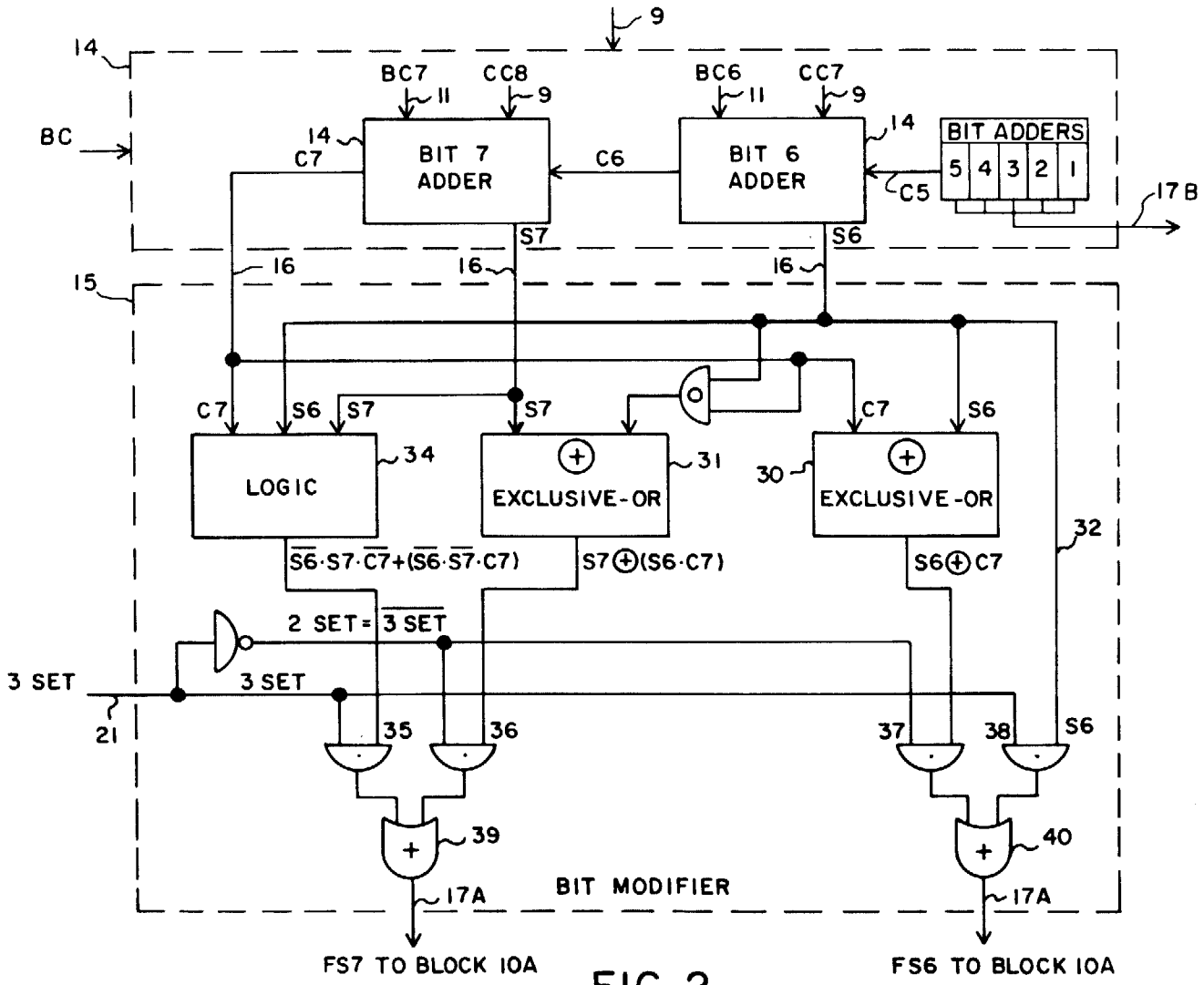
FIG. 2 illustrates in block diagram form features of the present invention particularly in their application to a line printer.

FIG. 2 illustrates one embodiment of the K-modifying logic. The operations are performed on 7-bit numbers which may be described briefly as follows.

(1) belt count —— 7-bit binary coded number with decimal equivalents from 32-127 for 2-set belt and 32-95 for 3-set belt; the bits are designated BC1-BC7 with BC1 being the least significant bit.

(2) column count —— 8-bit binary coded numbers with decimal equivalents from 1-132 for 132-column printer; the bits are designated CC1-CC8; the number CC/2 is accomplished by a 1-bit right shift so that the resulting CC/2 contains bits CC2-CC8 with decimal equivalents from 0-66.

(3) adder —— 2-bit binary addition (for bits 6 and 7) producing a sum bit, S, and a carry bit, C.

(4) exclusive-OR function —— $A \oplus B = A\overline{B} + \overline{A}B$

In order to satisfy the algorithm equation it is only necessary to modify the sum bits S6 and S7, when required. The modified outputs are then referred to as FS6 and FS7, and these are applied over lead 17A to block 10. The remaining bits 1-5 are applied directly over lead 17B to comparator 10.

The logic implementation follows from the truth tables which satisfy the algorithm equations for the two basic conditions of a 2-set belt of 96 characters each or a 3-set belt of 64 characters each. The signal on 21 is a logic 0 for a 2-set belt and logic 1 for a 3-set belt.

The truth tables are:

2-set belt

| $\Sigma = \frac{CC}{2} + BC$ | INPUTS C7 | S7 | S6 | OUTPUTS FS7 | FS6 |
|---|---|---|---|---|---|
| $\Sigma < 32$ | 0 | 0 | 0 | 0 | 0 |
| $32 \leq \Sigma < 64$ | 0 | 0 | 1 | 0 | 1 |
| $64 \leq \Sigma < 96$ | 0 | 1 | 0 | 1 | 0 |
| $96 \leq \Sigma < 128$ | 0 | 1 | 1 | 1 | 1 |
| $128 \leq \Sigma < 160$ | 1 | 0 | 0 | 0 | 1 |
| $160 \leq \Sigma < 192$ | 1 | 0 | 1 | 1 | 0 |
| $192 \leq \Sigma < 224$ | 1 | 1 | 0 | 1 | 1 |
| $224 \leq \Sigma < 256$ | 1 | 1 | 1 | | |

3-set belt

| $\Sigma = \frac{CC}{2} + BC$ | INPUTS C7 | S7 | S6 | OUTPUTS FS7 | FS6 |
|---|---|---|---|---|---|
| $\Sigma < 32$ | 0 | 0 | 0 | | |
| $32 \leq \Sigma < 64$ | 0 | 0 | 1 | 0 | 1 |
| $64 \leq \Sigma < 96$ | 0 | 1 | 0 | 1 | 0 |
| $96 \leq \Sigma < 128$ | 0 | 1 | 1 | 0 | 1 |
| $128 \leq \Sigma < 160$ | 1 | 0 | 0 | 1 | 0 |
| $160 \leq \Sigma < 192$ | 1 | 0 | 1 | 0 | 1 |
| $192 \leq \Sigma < 224$ | 1 | 1 | 0 | | |
| $224 \leq \Sigma < 256$ | 1 | 1 | 1 | | |

Output columns in the table are left blank for non-allowable conditions of $\sum = CC/2 + BC$. The first condition is that a belt count less than 32 cannot occur - therefore the sum CC/2 + BC cannot be less than 32.

The higher outputs are non-allowable when the sum count exceeds the certin printer parameters. For example in the one embodiment being discussed, for a 2-set belt, $BC_{max} = 127$ and $CC_{max} = 132$. The 132 represents the maximum number of columns and the 127represents the maximum belt count for the given number of fingers required for the ASCII code set which includes 32 through 127 for its printing characters.

$$\therefore \left(\frac{CC}{2} + BC\right)_{max} = \frac{132}{2} + 127 = 193$$

for 3-set belt printer $$BC_{max} = 95 \qquad CC_{max} = 132$$

$$\therefore \left(\frac{CC}{2} + BC\right)_{max} = \frac{132}{2} + 95 = 161$$

The truth tables can then be reduced in order to provide a logic implementation. In the case of the 2-set belt, the logic implementation is achieved as follows. The logic function performed by exclusive OR gate 30 is $FS6_2 = S6 \oplus C7$. The logic function performed by exclusive OR gate 31 is $FS7_2 = S7 \oplus (S6 \cdot C7)$. For the 3-set belt, the logic function performed on lead 32 is $FS6_3 = S6$. The logic function performed by block 34 is $FS7_3 = (S6 \cdot S7 \cdot \overline{C7}) + (\overline{S6} \cdot \overline{S7} \cdot C7)$.

Figure 3:
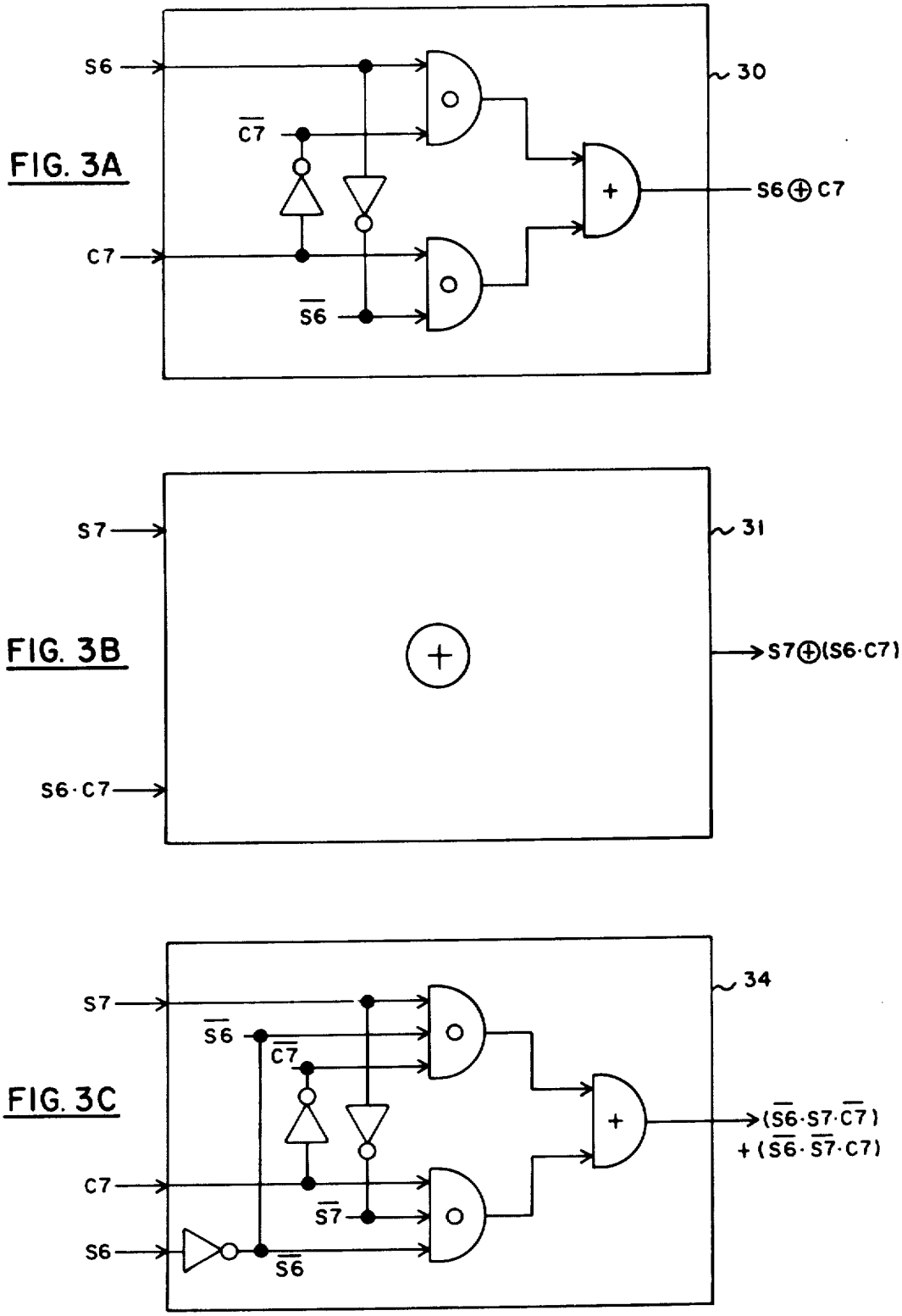
FIG. 3A, 3B and 3C illustrate further in block diagram form certain details useful in explaining the operation of the present invention.

FIG. 3A illustrates one embodimet for block 30, FIG. 3B illustrates one embodiment for block 31 and FIG. 3C illustrates one embodiment for carrying out the functions of block 34. In addition to providing modifiers for bits 6 and 7 of the sum output of adder 14, means are provided to select the proper modification under control of the signal on line 21. For a 2-set belt, outputs of gates 36 and 37 are selected, namely the outputs of 31 and 30. For a 3-set belt, outputs of gates 34 and 31 are selected, namely the outputs of 34 and lead 32. OR gates 39 and 40 provide modified bit signals for bits 6 and 7 positions.

While the invention was described in terms of an application to a belt type of line printer and in terms of a type carrier employing a 64 character set and a 96 character set, our invention if applicable to other character length sets on a carrier and other types of printers.

The embodiments disclosed and discussed hereinabove may be modified by those skilled in the art. It is contemplated in the appended claims to include all such modifications which come within the spirit and scope of the teachings herein.

What we claimed as new and desire to secure by Letters Patent of the United States is:

1. In combination, a source of a plurality of information signals, each of said information signals comprising a coded pulse group each of which comprises a given number of information bits, said coded pulse groups representing the values of respective functions varying with time, means for algebraically combining first and second ones of said information signals to obtain combined signals comprising coded pulse groups, means for processing selected bit portions of said combined signals to obtain a first set of signals if the value of such combined signals is less than a first predetermined limit and to obtain a second set of signals if the value of such combined signals is greater than or equal to said first predetermined limit but less than a second predetermined limit and to obtain a third set of signals if the value of such combined signals is greater than or equal to said second predetermined limit, said means for processing comprising means for analyzing one of said signals that was combined to determine if its value is greater than a first predetermined limit to obtain a first given signal and to determine if its value is less than said last named first predetermined limit to obtain a second given signal, means for modifying said selected bit portions in a first manner to obtain first modified selected bit portions of said combined signals, and means for further modifying said modified bit portions of said combined signals in accordance with said first and second given signals to provide said first, second and third sets of signals.

2. In combination, a source of first, second and third information signals, each of said information signals comprising a coded pulses group each of which comprises a given number of information bits, said coded pulse groups representing the values of respective functions varying with time, means for algebraically combining first and second ones of said information signals to obtain combined signals comprising coded pulse groups, means for processing selected bit portions of said combined signals to obtain a first set of signals if the value of such combined signals is less than a first predetermined limit, to obtain a second set of signals if the value of such combined signals is greater than or equal to said first predetermined limit but less than a second predetermined limit and to obtain a third set of signals if the value of such combined signals is greater than or equal to said second predetermined limit, said means for processing comprising means for analyzing one of said signals that was combined to determine if its value is greater than a first predetermined limit to obtain a first given signal and to determine if its value is less than said last named first predetermined limit to obtain a second given signal, means for modifying said selected bit portions in a first manner to obtain first modified selected bit portions of said combined signals, and means for further modifying said first modified selected bit portions of said combined signals in accordance with said first and second given signals to provide said first, second and third sets of signals, and means for comparing said last named sets of signals and said third one of said information signals to provide output signals.

3. In combination, a source of first, second and third information signals, each of said information signals comprising a coded pulse group each of which comprises a given number of information bits, said coded pulse groups representing the values of respective functions varying with time, means for algebraically combining first and second ones of said information signals to obtain combined signals comprising coded pulse groups, means for processing selected bit portions of said combined signals to obtain a first set of signals if the value of such combined signals is less than a first predetermined limit and to obtain a second set of signals if the value of such combined signals is greater than or equal to said first predetermined limit but less than a second predetermined limit and to obtain a third set of signals if the value of such combined signals is greater than or equal to said second predetermined limit, said means for processing comprising means for analyzing one of said signals that was combined to determine if its value is greater than a first predetermined limit to obtain a first given signal and to determine if its value is less than said last named first predetermined limit to obtain a second given signal, means for modifying said selected bit portions in a first manner to obtain first modified selected bit portions of said combined signals, and means for further modifying said modified selected bit portions of said combined signals in accordance with said first and second given signals to provide said first, second and third sets of signals, and means for comparing said sets of signals and said third one of said information signals to provide output signals.

4. In combination, a source of first, second and third information signals, each of said information signals comprising a coded pulse group each having at least seven information bit portions, said coded pulse groups representing the value of respective functions varying with time, means for algebraically combining first and second ones of said information signals to obtain combined signals comprising coded pulse groups, means for processing the bit 6 and bit 7 portions of said combined signals to obtain a first set of signals if the value of such combined signals is less than a first predetermined limit, means for processing said bit 6 and bit 7 portions to obtain a second set of signals if the value of such combined signals is greater than or equal to said first predetermined limit but less than a second predetermined limit, means for processing said bit 6 and bit 7 portions to obtain a third set of signals if the value of such combined signals is greater than or equal to said second predetermined limit, said means for processing comprising means for analyzing one of said combined signals to determine if its value is greater than a first predetermined limit to obtain a first given signal, means for analyzing said last named one of said combined signals to determine if its value is less than said last named first predetermined limit to obtain a second given signal, means for modifying said bit 6 and bit 7 portions of said combined signals to obtain modified selected bit 6 and bit 7 portions of said combined signals, and means for further modifying said first mentioned modified bit 6 and bit 7 portions of said combined signals in accordance with said first and second given signals to provide said first, second and third sets of signals, and means for comparing said last named sets of signals and said third one of said information signals to provide second output signals.

* * * * *

UNITED STATES PATENT OFFICE

CERTIFICATE OF CORRECTION

Patent No. 4,144,560 Dated March 13, 1979

Inventor(s) Samuel C. Harris, Jr. and Terry L. Hewitt

It is certified that error appears in the above-identified patent and that said Letters Patent are hereby corrected as shown below:

Col. 1, line 10, cancel "circuit" and insert -- circuits --

Col. 3, line 18, cancel "chracter" and insert -- character --

Col. 3, line 52, cancel "3,803,358" and insert -- 3,803,558 --

Col. 5, line 1, cancel"signal" and insert -- signals --

Col. 6, line 9, cancel "outut" and insert -- output --

Col. 6, line 62, cancel "th" and insert -- the --

Col. 8, line 46, cancel "certin" and insert -- certain --

Col. 9, line 6, cancel "embodimet" and insert -- embodiment --

Signed and Sealed this

*Eleventh* Day of *December 1979*

[SEAL]

*Attest:*

*Attesting Officer*

SIDNEY A. DIAMOND

*Commissioner of Patents and Trademarks*